US008152265B2

(12) United States Patent
Saita

(10) Patent No.: US 8,152,265 B2
(45) Date of Patent: Apr. 10, 2012

(54) INKJET RECORDING APPARATUS AND METHOD OF INVESTIGATING EJECTION FAILURE DETERMINATION PERFORMANCE

(75) Inventor: Hirofumi Saita, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 234 days.

(21) Appl. No.: 12/710,814

(22) Filed: Feb. 23, 2010

(65) Prior Publication Data

US 2010/0214345 A1 Aug. 26, 2010

(30) Foreign Application Priority Data

Feb. 24, 2009 (JP) ..... 2009-041121

(51) Int. Cl.
*B41J 29/393* (2006.01)

(52) U.S. Cl. ..... 347/19; 347/5; 347/14

(58) Field of Classification Search ..... 347/5, 6, 347/9, 14, 15, 19, 20
See application file for complete search history.

(56) References Cited

U.S. PATENT DOCUMENTS

| | | | | |
|---|---|---|---|---|
| 7,533,953 | B2 * | 5/2009 | Vladislav et al. | 347/14 |
| 7,540,580 | B2 * | 6/2009 | Oku | 347/19 |
| 2005/0030327 | A1 | 2/2005 | Tatsumi | |
| 2006/0274106 | A1 | 12/2006 | Park | |
| 2007/0040878 | A1 | 2/2007 | Ikefuji et al. | |

FOREIGN PATENT DOCUMENTS

| | | | |
|---|---|---|---|
| JP | 2004-9474 | A | 1/2004 |
| JP | 2005-67191 | A | 3/2005 |
| JP | 2006-240232 | A | 9/2006 |
| JP | 2006-335070 | A | 12/2006 |
| JP | 2007-54970 | A | 3/2007 |

* cited by examiner

*Primary Examiner* — Juanita D Jackson
(74) *Attorney, Agent, or Firm* — Birch, Stewart, Kolasch & Birch, LLP

(57) ABSTRACT

An inkjet recording apparatus includes: a head having a plurality of nozzles for ejecting ink onto a recording medium; a conveyance device which conveys the recording medium in a prescribed direction along a conveyance path; an investigation pattern generation device which generates a thinned-out investigation pattern that is to be output by causing the nozzles other than a portion of the plurality of nozzles of the head to eject the ink; a reading device which is provided on the conveyance path and which reads in the investigation pattern output onto the recording medium; and a checking device which performs comparison between data of the investigation pattern read in by the reading device and data of the investigation pattern generated by the investigation pattern generation device, wherein a determination rate of ejection failure nozzles is found from result obtained by outputting the investigation pattern generated by the investigation pattern generation device onto the recording medium from the head, reading in the output investigation pattern by the reading device, and performing the comparison between the data of the investigation pattern thus read in and the data of the investigation pattern generated by the investigation pattern generation device.

12 Claims, 14 Drawing Sheets

INKJET RECORDING APPARATUS AND METHOD OF INVESTIGATING EJECTION FAILURE DETERMINATION PERFORMANCE

BACKGROUND OF THE INVENTION

1. Field of the Invention

The present invention relates to an inkjet recording apparatus and a method of investigating ejection failure (non-ejection) determination performance, and more particularly, to an inkjet recording apparatus having a mechanism for checking the determination performance of an ejection failure determination test pattern.

2. Description of the Related Art

As an image forming apparatus, an inkjet recording apparatus (an inkjet printer) is known which comprises an inkjet head having an arrangement of a plurality of nozzles for ejecting ink as liquid droplets and which forms an image on a recording medium by ejecting the ink from the nozzles toward a recording medium, while causing the inkjet head and the recording medium to move relatively to each other.

Various methods are known as ink ejection methods for an inkjet recording apparatus of this kind. For example, known methods include: a piezoelectric method according to which a diaphragm that constitutes one portion of a pressure chamber (ink chamber) is caused to deform by the deformation of a piezoelectric element (piezoelectric ceramic), thereby changing the volume of the pressure chamber, ink being introduced from an ink supply channel into the pressure chamber when the volume of the pressure chamber is increased and ink being ejected from a nozzle in the form of a liquid droplet when the volume of the pressure chamber is decreased; and a thermal inkjet method according to which a gas bubble is created by heating ink, and the ink is ejected due to the expansive energy created as this gas bubble grows.

In an image forming apparatus having an inkjet head such as an inkjet recording apparatus, ink is supplied to the inkjet head via an ink supply channel from an ink tank which stores the ink, and the ink is ejected by the various ejection methods described above, but in order to form a high-quality image, it is necessary to perform the ejection in a stable fashion in such a manner that the ink ejection amount, ejection speed, ejection direction and shape (volume) of the ejected ink, and the like, are uniform at all times.

However, during printing, the nozzles of an inkjet head are filled with ink at all times in order that printing is carried out immediately when there is a print instruction, and the ink in the nozzles is exposed to air. Therefore, the ink in nozzles which do not perform ejection for a long period of time dries, the ink viscosity rises, suitable ink droplets cannot be ejected, and nozzle blockages or ejection failures occur. Furthermore, gas bubbles which have become intermixed into the ink supply channel, and the like, stagnate, shutting off the supply of ink, or if such ejection is continued for a long period of time, then ink refilling may be too slow and ejection defects may occur.

Due to these various causes, if an ejection failure occurs or it becomes impossible to achieve stable ink ejection, as described previously, then it becomes necessary to carry out maintenance of the ejection head. Therefore, various techniques are known for determining whether or not the ink has been ejected stably and whether an ejection failure has occurred in the inkjet head.

For example, a printing apparatus is known which records a prescribed test pattern at a prescribed resolution on printing paper by means of a recording head having a plurality of nozzles, and then judges nozzle abnormalities on the basis of data obtained by reading in and interpolating the test chart at a resolution lower than the resolution of the recording head, by means of a scanner (see, for example, Japanese Patent Application Publication No. 2007-54970, and the like).

Furthermore, there is also known a line inkjet printer which carries out printing with a fixed print head that is wider than the width of the print area on the printing paper, wherein a test pattern printed by staggering the ejection nozzle by a uniform interval in one portion of the paper is read in by a scanner unit which reads the print results in a wider area than the print width, the read test pattern is binarized, and an ejection failure check is carried out for all nozzles, every plurality of pages or every page (see, for example, Japanese Patent Application Publication No. 2004-9474, and the like).

Furthermore, technology is also known according to which printing is carried out onto recording paper using a print head in which a plurality of nozzles which eject ink are arranged so as to correspond to the full width of a print medium following a main scanning direction, integrated data is obtained by reading in the printed image with a line sensor and integrating the read pixel data thus obtained over a prescribed width in the recording paper conveyance direction, and unsuitable nozzles are identified by comparing the integrated data with the integral value of the expected reading data which is expected from the pixels where droplets ought to have been ejected (see, for example, Japanese Patent Application Publication No. 2005-67191).

Furthermore, technology is known according to which a printed test pattern is scanned and ejection failure nozzles are judged by determining nozzles where the quantity of light determined by a light sensor is equal to or lower than a threshold value (see, for example, Japanese Patent Application Publication No. 2006-335070).

Furthermore, for instance, technology is known according to which a chart for determining ejection failures in a recording head, constituted by a figure for determining individual nozzles, a figure for identifying a determination start position and a figure for identifying a determination reference position, is printed onto a conveyance belt which conveys a recording medium (see, for example, Japanese Patent Application Publication No. 2006-240232, or the like).

In an image output apparatus capable of recording an image over the whole width of the recording medium by scanning over a recording medium just once by inkjet recording, output from the respective nozzles of the inkjet head is performed sequentially, while leaving an interval therebetween, in such a manner that the presence or absence of output from each nozzle is investigated at a lower resolution than the output resolution. In this case, by adopting a determination pattern in which only the output from one nozzle in an output of high resolution is read with respect to one pixel on the output determination side which has low resolution, the presence or absence of output for each nozzle, in other words, whether or not the nozzle is in an ejection failure state, is judged by means of determination image data. Here, a captured image is subjected to binarization, image sharpening, or the like, under previously determined conditions, and even if the ink color or paper is changed, the output from the respective nozzles is determined under the same conditions.

If the number of determined ejection failure nozzles has exceeded a previously determined uniform value, then the operation of the image output apparatus is transferred to the maintenance mode. If the mode is transferred to the maintenance mode, then flushing, wiping, capping, or the like, is carried out, whereupon the mode is returned to the original normal image output mode.

However, in ejection failure investigation such as the related art examples described above, since the ejection failure determination itself is not normal, due to reasons such as inappropriate binarization processing or image sharpening, then image recording is carried out while the ejection failure continues and the image quality deteriorates, or conversely, the apparatus is transferred to maintenance mode when there is no actual need, and hence the image recording efficiency becomes worse.

SUMMARY OF THE INVENTION

The present invention has been contrived in view of these circumstances, an object thereof being to provide an inkjet recording apparatus and a method of investigating ejection failure detection performance whereby the ejection failure nozzle determination performance is maintained at high performance, and productivity can be raised, even if the paper, ink, or the like, is changed.

In order to attain an object described above, one aspect of the present invention is directed to an inkjet recording apparatus, comprising: a head having a plurality of nozzles for ejecting ink onto a recording medium; a conveyance device which conveys the recording medium in a prescribed direction along a conveyance path; an investigation pattern generation device which generates a thinned-out investigation pattern that is to be output by causing the nozzles other than a portion of the plurality of nozzles of the head to eject the ink; a reading device which is provided on the conveyance path and which reads in the investigation pattern output onto the recording medium; and a checking device which performs comparison between data of the investigation pattern read in by the reading device and data of the investigation pattern generated by the investigation pattern generation device, wherein a determination rate of ejection failure nozzles is found from result obtained by outputting the investigation pattern generated by the investigation pattern generation device onto the recording medium from the head, reading in the output investigation pattern by the reading device, and performing the comparison between the data of the investigation pattern thus read in and the data of the investigation pattern generated by the investigation pattern generation device.

According to this aspect of the invention, it is possible to maintain a high ejection failure nozzle determination performance even if the paper or ink, or the like, is changed, and therefore productivity can be raised.

Desirably, when the determination rate of ejection failure nozzles found is lower than a predetermined value, conditions for performing the comparison are changed to raise the determination rate of ejection failure nozzles.

According to this aspect of the invention, it is possible to maintain a high ejection failure nozzle determination performance.

Desirably, the conditions for performing the comparison are changed by changing a threshold value for binarizing the data of the investigation pattern read in by the reading device.

Desirably, the conditions for performing the comparison is changed by changing a prescribed coefficient for applying a sharpening process to the data of the investigation pattern read in by the reading device.

According to these aspects of the invention, it is possible to maintain a high ejection failure nozzle determination performance.

Desirably, the head is a full line type recording head; and the conveyance device causes relative conveyance between the recording medium and the head in a direction substantially perpendicular to a breadthways direction of the recording medium.

Desirably, the head is a shuttle type head which moves in a direction substantially perpendicular to the prescribed direction in which the conveyance device conveys the recording medium.

In this way, the present invention can be applied also to a shuttle type head, as well as to a full line type of head.

In order to attain an object described above, another aspect of the present invention is directed to a method of investigating ejection failure determination performance, comprising the steps of: generating a thinned-out investigation pattern that is to be output by causing nozzles other than a portion of a plurality of nozzles of a head to eject ink; outputting the investigation pattern onto a recording medium; reading the investigation pattern output onto the recording medium; performing comparison between data of the read investigation pattern and data of the generated investigation pattern; and finding a determination rate of ejection failure nozzles according to result obtained by performing the comparison.

According to this aspect of the invention, it is possible to maintain a high ejection failure nozzle determination performance even if the paper or ink, or the like, is changed, and therefore productivity can be raised.

Desirably, when the determination rate of ejection failure nozzles found is lower than a predetermined value, conditions for performing the comparison are changed to raise the determination rate of ejection failure nozzles.

Desirably, the conditions for performing the comparison is changed by changing a threshold value for binarizing the data of the investigation pattern read in by the reading device.

Desirably, the conditions for performing the comparison are changed by changing a prescribed coefficient for applying a sharpening process to the data of the investigation pattern read in by the reading device.

Desirably, the head is a full line type recording head; and relative conveyance between the recording medium and the head is caused in a direction substantially perpendicular to a breadthways direction of the recording medium.

Desirably, the head is a shuttle type head which moves in a direction substantially perpendicular to a direction in which the recording medium is conveyed.

According to the present invention, it is possible to maintain a high ejection failure nozzle determination performance even if the paper or ink, or the like, is changed, and therefore productivity can be raised.

DESCRIPTION OF THE PREFERRED EMBODIMENTS

Below, an inkjet recording apparatus and a method of investigating ejection failure determination performance relating to an embodiment of the present invention will be described in detail with reference to the accompanying drawings.

Figure 1:
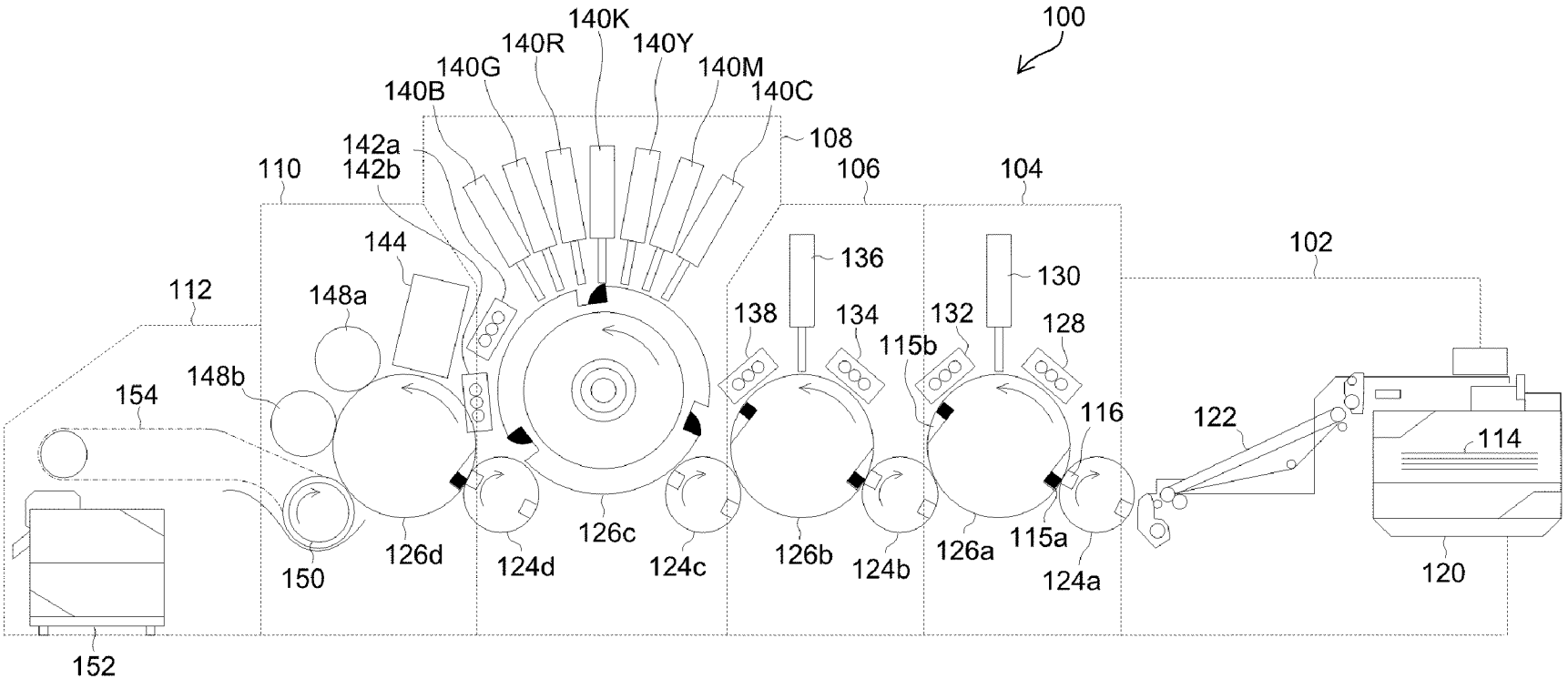
FIG. 1 is a schematic drawing of an inkjet recording apparatus which incorporates an inkjet head relating to one embodiment of the present invention.

FIG. 1 is a compositional diagram showing a schematic view of an inkjet recording apparatus (image forming apparatus) which incorporates an inkjet head relating to one embodiment of the present invention.

As illustrated in FIG. 1, the inkjet recording apparatus 100 functioning as an image forming apparatus principally comprises: a paper supply unit 102 which supplies a recording medium 114; a permeation suppression processing unit 104 which carries out permeation suppression processing on the recording medium 114; a treatment agent deposition unit 106 which deposits treatment agent onto the recording medium 114; a print unit 108 which forms an image by depositing colored ink onto the recording medium 114; a fixing treatment unit 110 which carries out a fixing process so that an image recorded on the recording medium 114 is fixed; and a paper output unit 112 which conveys and outputs the recording medium 114 on which an image has been formed.

The paper supply unit 102 comprises a magazine (paper supply tray) 120 which stores recording media 114 in a stacked fashion, and the recording medium 114 is supplied one sheet at a time to the paper supply tray (feeder board) 122 from the magazine 120. The recording medium 114 which has been conveyed to the paper supply tray 122 is supplied via a transfer drum 124*a* to the surface (circumferential surface) of a pressure drum (permeation suppression agent drum) 126*a* of the permeation suppression processing unit 104.

In the permeation suppression agent processing unit 104, a paper preheating unit 128, a permeation suppression agent head 130 and a permeation suppression agent drying unit 132 are provided in sequence from the upstream side in the direction of rotation, so as to oppose the surface of the pressure drum 126*a*. The permeation suppression agent head 130 deposits permeation suppression agent onto the recording medium 114 by ejecting permeation suppression agent onto the recording medium 114 which is held on the pressure drum 126*a*.

The method of depositing permeation suppression agent onto the recording medium 114 is not limited to a method which ejects permeation suppression agent from a permeation suppression agent head 130 in this way. For example, it is also possible to use other methods, such as a spray method, application method, and the like.

Furthermore, a thermoplastic resin latex solution is suitable for use as a permeation suppression agent, but the permeation suppression agent is not limited to this and it is also possible to use plate-shaped particles (mica or the like), or a hydrophobic agent (a fluorine coating agent), or the like.

A treatment liquid deposition unit 106 is provided after the permeation suppression processing unit 104 (to the downstream side of same in terms of the direction of conveyance of the recording medium 114). A transfer drum (intermediate conveyance drum) 124*b* is provided between the pressure drum (permeation suppression agent drum) 126*a* of the permeation suppression processing unit 104 and the pressure drum (treatment liquid drum) 126*b* of the treatment liquid deposition unit 106, so as to make contact with same. By adopting this structure, after the recording medium 114 which is held on the pressure drum 126*a* of the permeation suppression processing unit 104 has been subjected to permeation suppression agent processing, the recording medium 114 is transferred via the transfer drum 124*b*, which is rotatable in the clockwise direction in FIG. 1, to the pressure drum (treatment liquid drum) 126*b* of the treatment liquid deposition unit 106.

In the treatment liquid deposition unit 106, a paper preheating unit 134, a treatment liquid head 136 and a treatment liquid drying unit 138 are provided in sequence from the upstream side in the direction of rotation, so as to oppose the surface of the pressure drum (treatment liquid drum) 126*b*.

The treatment liquid deposited from the treatment liquid head 136 onto the recording medium 114 in the treatment liquid deposition unit 106 is an acidic liquid having an action of aggregating a coloring material contained in ink which is to be printed onto the recording medium 114 in a print unit 108 in a subsequent stage.

A print unit 108 is provided after the treatment liquid deposition unit 106. A transfer drum (intermediate conveyance drum) 124*c*, which is composed rotatably in the clockwise direction in FIG. 1, is provided between the pressure drum (treatment liquid drum) 126*b* of the treatment liquid deposition unit 106 and the pressure drum (drawing drum) 126*c* of the print unit 108, so as to make contact with same. By means of this structure, the treatment liquid deposition unit 106 deposits the treatment liquid onto the recording medium 114 held on the pressure drum 126*b* of the treatment liquid deposition unit 106, thereby forming a solid or semi-solid layer of aggregating treatment agent, whereupon the recording medium 114 is transferred via the transfer drum 124*c* to the pressure drum (drawing drum) 126*c* of the print unit 108.

In the print unit 108, ink heads 140C, 140M, 140Y, 140K, 140R, 140G and 140B which correspond respectively to the seven colors of ink, C (cyan), M (magenta), Y (yellow), K (black), R (red), G (green) and B (blue), and solution drying units 142*a* and 142*b* are provided respectively at positions opposing the surface of the pressure drum (drawing drum) 126*c*, in this order from the upstream side in terms of the direction of rotation of the pressure drum 126*c*.

The ink heads 140C, 140M, 140Y, 140K, 140R, 140G and 104B employ inkjet type recording heads (inkjet heads), similarly to the permeation suppression agent head 130 and the treatment liquid head 136. In other words, the ink heads 140C, 140M, 140Y, 140K, 140R, 140G and 140B respectively eject droplets of corresponding colored inks onto a recording medium 114 which is held on the pressure drum (drawing drum) 126*c*.

The ink heads 140C, 140M, 140Y, 140K, 140R, 140G and 140B are each full-line inkjet heads having a length corresponding to the maximum width of the image forming region of the recording medium 114 held on the pressure drum (drawing drum) 126*c*, and having a plurality of nozzles for ejecting ink arranged through the full width of the image forming region, on the ink ejection surface of the head.

Figure 2:
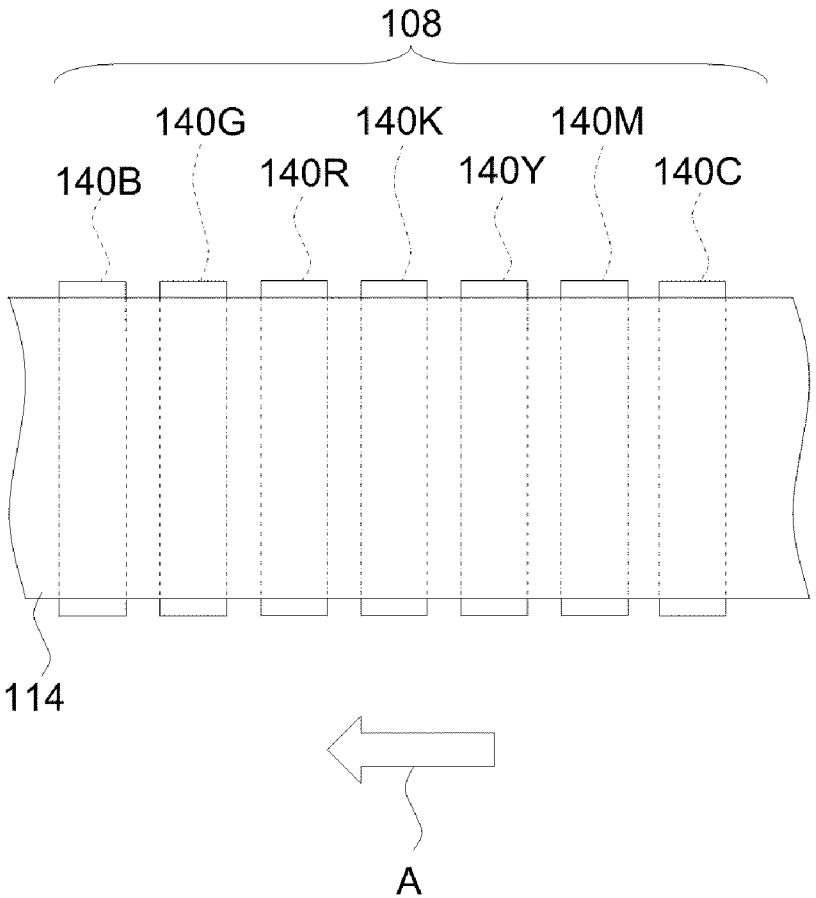
FIG. 2 is a principal plan diagram of the peripheral area of a print unit of an inkjet recording apparatus.

FIG. 2 is a principal plan diagram showing the periphery of the print unit 108 of the inkjet recording apparatus 100.

As shown in FIG. 2, the print unit 108 includes so-called full line type of heads (the ink heads 140C, 140M, 140Y, 140K, 140R, 140G and 140B) which each have a length corresponding to the maximum width of the image forming region of the recording medium 114. The ink heads 140C, 140M, 140Y, 140K, 140R, 140G and 140B are disposed in a direction (main scanning direction) which is perpendicular to the paper conveyance direction (sub-scanning direction) indicated by the arrow A in FIG. 2.

The print heads 140C, 140M, 140Y, 140K, 140R, 140G and 140B are constituted by line heads in which a plurality of ink ejection ports (nozzles) are arranged through a length exceeding at least one edge of the maximum size recording paper 114 intended for use with the inkjet recording apparatus 100.

The ink heads 140C, 140M, 140Y, 140K, 140R, 140G and 140B corresponding to inks of respective colors are disposed in the sequence cyan (C), magenta (M), yellow (Y), black (K), red (R), green (G), and blue (B), from the upstream side (the right-hand side in FIG. 2) following the conveyance direction of the recording medium 114 (as indicated by arrow A in FIG. 2). A color print can be formed on the recording medium 114 by ejecting the inks from the ink heads 140C, 140M, 140Y, 140K, 140R, 140G and 140B, respectively, onto the recording paper 114 while conveying the recording medium 114.

The print unit 108, in which the full-line heads covering the entire width of the paper are thus provided for the respective ink colors, can record an image over the entire surface of the recording medium 114 by performing the action of moving the recording paper 114 and the print unit 108 relatively to each other in the paper conveyance direction (sub-scanning direction) just once (in other words, by means of a single sub-scan). Higher-speed printing is thereby made possible and productivity can be improved in comparison with a shuttle (serial) type head configuration in which a recording head moves reciprocally in a direction (main scanning direction) which is perpendicular to the paper conveyance direction.

Here, the terms of the main scanning direction and sub-scanning direction are used in the following senses. More specifically, in a full-line head comprising rows of nozzles that have a length corresponding to the entire width of the recording medium, "main scanning" is defined as printing one line (a line formed of a row of dots, or a line formed of a plurality of rows of dots) in the breadthways direction of the paper (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by this main scanning action (the lengthwise direction of the band-shaped region thus recorded) is called the "main scanning direction".

On the other hand, the "sub-scanning" is defined as to repeatedly perform printing of one line (a line formed of a row of dots, or a line formed of a plurality of rows of dots) formed by the main scanning action, while moving the full-line head and the recording medium relatively to each other. Furthermore, the direction in which the sub-scanning is performed is called the sub-scanning direction. Consequently, the conveyance direction of the recording medium (as indicated by arrow A in FIG. 2) is the sub-scanning direction and the direction perpendicular to same (the lengthwise direction of the respective heads in FIG. 2) is the main scanning direction.

The solution drying units 142*a* and 142*b* have a composition which comprises heater whose temperature can be controlled within a prescribed range, similarly to the paper preheating units 128 and 134, the permeation suppression agent drying unit 132, and the treatment liquid drying unit 138, which are described above. If ink droplets are ejected onto the layer of aggregating treatment agent in a solid state or semi-solid state which has been formed on the recording medium 114, an ink aggregate (coloring material aggregate) is formed on the recording medium 114, and furthermore, the ink solvent which has separated from the coloring material spreads and a liquid layer of dissolved aggregating treatment agent is formed. The solvent component (liquid component) left on the recording medium 114 in this way is a cause of curling of the recording medium 114 and also leads to deterioration of the image.

Therefore, in the present embodiment, after ejecting droplets of the corresponding colored inks onto the recording medium 114 respectively from the ink heads 140C, 140M, 140Y, 140K, 140R, 140G and 140B, heating is carried out by the heaters of the solution drying units 142*a* and 142*b*, and the solvent component is evaporated off and dried.

The fixing processing unit 110 is provided subsequent to the print unit 108 as illustrated in FIG. 1, and a transfer drum 124*d* is provided between the pressure drum (drawing drum) 126*c* of the print unit 108 and the pressure drum (fixing drum) 126*d* of the fixing processing unit 110 so as to make contact with the pressure drums. By this means, after the respective colored inks have been deposited on the recording medium 114 which is held on the pressure drum (drawing drum) 126*c* of the print unit 108, the recording medium 114 is transferred via the transfer drum (intermediate conveyance drum) 124*d* to the pressure drum (fixing drum) 126*d* of the fixing processing unit 110.

In the fixing processing unit 110, an in-line sensor 144 which reads in the print results of the print unit 108, and heating rollers 148*a* and 148*b* are provided respectively at positions opposing the surface of the pressure drum (fixing drum) 126*d*, in this order from the upstream side in terms of the direction of rotation of the pressure drum 126*d*.

In the present embodiment, a mode based on application of heat and pressure is described as one example of a fixing device after image recording, but it is also possible to adopt other compositions, such as a composition in which a transparent ultraviolet-curable ink droplet ejection unit ejects droplets of transparent ultraviolet-curable ink, and the transparent ultraviolet-curable ink is cured and the image is thereby fixed onto the recording medium 114 by irradiating ultraviolet light thereon.

The in-line sensor 144 includes an image sensor (a line sensor, or the like) which captures the print result of the print unit 108 (the droplet ejection results of the respective ink heads 140C, 140M, 140Y, 140K, 140R, 140G and 140B), and functions as a device for checking for nozzle blockages and other ejection defects on the basis of the droplet ejection image read out by the image sensor.

The in-line sensor 144 employed in the present example comprises a line CCD in which a plurality of investigation pixels (read elements) are arranged in one row in the breadthways direction of the recording medium 114 (or an area sensor in which a plurality of investigation pixels are arranged in a two-dimensional configuration), and a condensing lens (reducing grass) disposed in such a manner that the line CCD (or area sensor) can read in the whole of the breadthways direction of the recording medium 114 at the same time. The in-line sensor 144 has a reading resolution that is lower than the recording resolution of each of the ink heads 140C, 140M, 140Y, 140K, 140R, 140G and 140B of the print unit 108.

In the inkjet recording apparatus 100 according to the present embodiment, as illustrated in FIG. 1, the paper output unit 112 is provided subsequent to the fixing processing unit 110. In the paper output unit 112, there are provided: a paper output drum 150 which receives a recording medium 114 subjected to fixing processing, a paper output platform 152 on which recording media 114 is stacked, and a paper output chain 154 comprising a plurality of paper output grippers, which are spanned between a sprocket provided on the paper output drum 150 and a sprocket provided above the paper output platform 152.

Next, the structure of the ink heads 140C, 140M, 140Y, 140K, 140R, 140G and 140B disposed in the print unit 108 will be described in detail. The ink heads 140C, 140M, 140Y, 140K, 140R, 140G and 140B have a common structure, and therefore, below, these heads are represented by an ink head (hereinafter, simply called a "head") which is indicated by reference numeral 160.

Figure 3A:
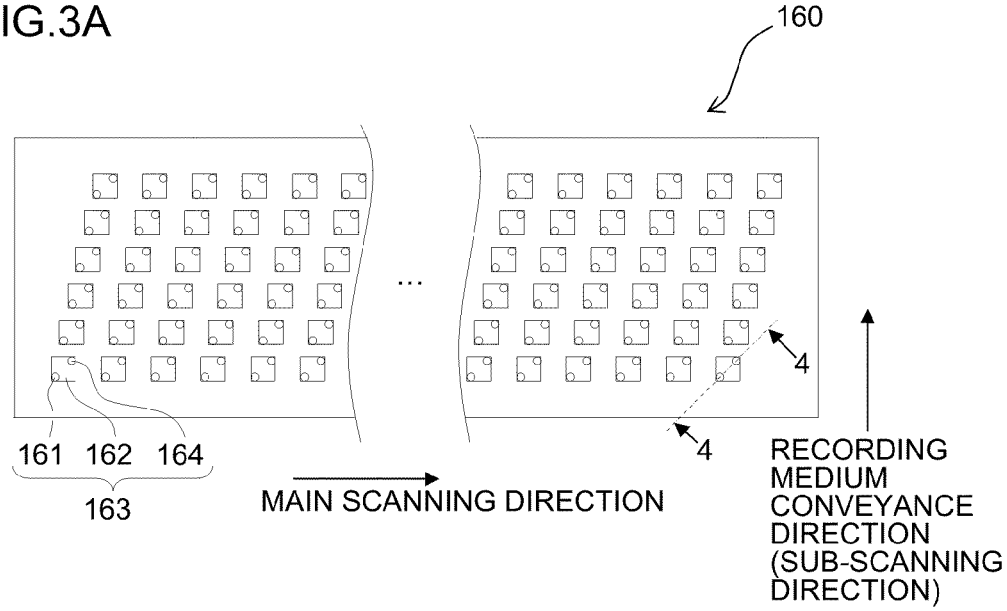
FIGS. 3A to 3C are plan view perspective diagrams showing examples of the head shown in FIG. 1.
Figure 3B:
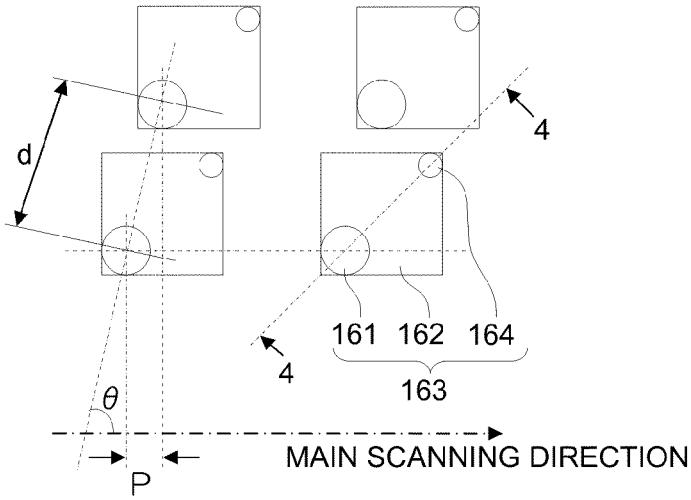
Figure 3C:
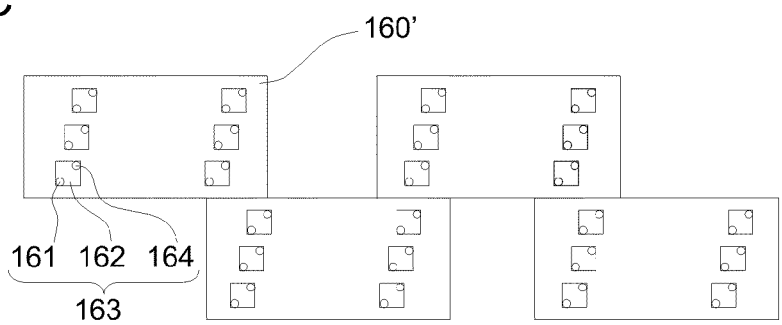

FIG. 3A is a perspective plan view illustrating an example of the configuration of an ink head 160, FIG. 3B is an enlarged view of a portion thereof. FIG. 3C is a perspective plan view illustrating another example of the configuration of the ink head 160.

As shown in FIG. 3A and FIG. 3B, the pressure chambers 162 provided corresponding to the respective nozzles 161 are approximately square-shaped in plan view, and a nozzle 161 and a supply port 164 are provided respectively at either corner of a diagonal of each pressure chamber 162.

The nozzle pitch in the ink head 160 should be minimized in order to maximize the density of the dots formed on the surface of the recording medium 114. As illustrated in FIGS. 3A and 3B, the ink head 160 according to the present embodiment has a structure in which a plurality of ink chamber units 163, each comprising a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction) is reduced and high nozzle density is achieved.

In other words, as shown in FIG. 3B, ink chamber units 163 are arranged in such a manner that the nozzles 161 are aligned at a uniform pitch d in a direction forming a certain angle θ with respect to the main scanning direction. By adopting a structure of this kind, the pitch P of the nozzles projected to an alignment in the main scanning direction is d×cos θ, and the configuration can be treated as equivalent to one in which the nozzles 161 are arranged in a straight line at a uniform pitch P in the main scanning direction. By means of this composition, it is possible to achieve a nozzle composition of high density, in which the nozzle columns projected to an alignment in the main scanning direction reach a total of 2400 per inch (2400 nozzles per inch).

The mode of forming one or more nozzle rows through a length corresponding to the entire width of the recording medium 114 in a direction substantially perpendicular to the conveyance direction of the recording medium 114 is not limited to the example described above. For example, instead of the configuration in FIG. 3A, as illustrated in FIG. 3C, a line head having nozzle rows of a length corresponding to the entire width of the recording medium 114 can be formed by arranging and combining, in a staggered matrix, short head blocks 160' having a plurality of nozzles 161 arrayed in a two-dimensional fashion. Furthermore, although not illustrated in the drawings, it is also possible to compose a line head by arranging short heads in one row.

Figure 4:
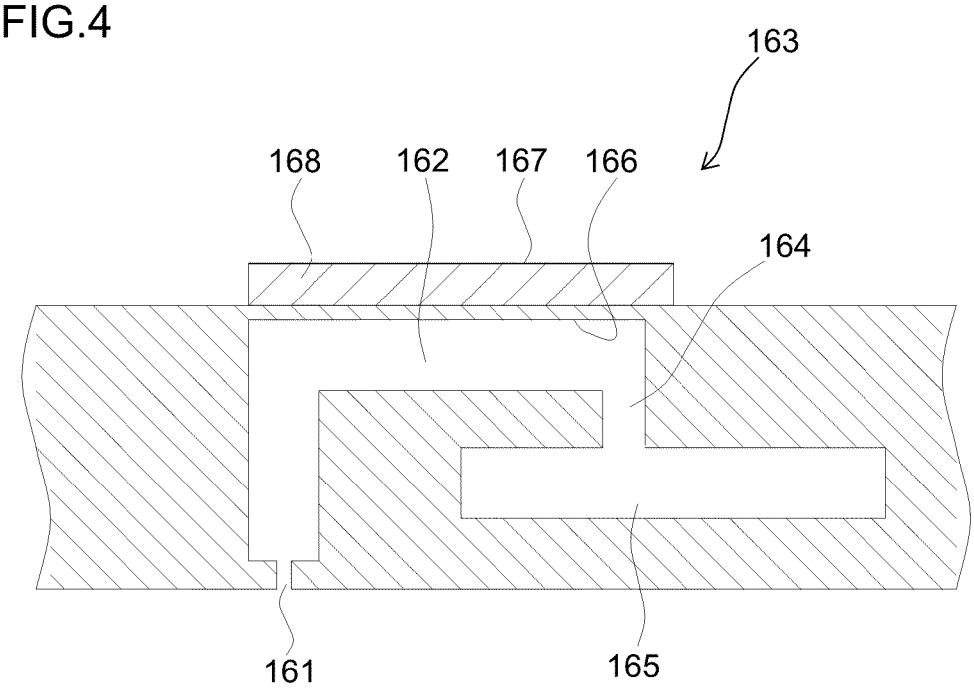
FIG. 4 is a cross-sectional diagram along line 4-4 in FIGS. 3A and 3B.

Furthermore, FIG. 4 is a cross-sectional diagram along line 4-4 in FIG. 3A and FIG. 3B, and shows the composition of an ink chamber unit.

As illustrated in FIG. 4, each pressure chamber 162 is connected to a common channel 165 through the supply port 164. The common channel 165 is connected to an ink supplied tank (not illustrated), which is a base tank that supplies ink, and the ink supplied from the ink supplied tank is delivered through the common flow channel 165 to the pressure chambers 162.

A piezoelectric element 168 provided with an individual electrode 167 is bonded to a pressure plate 166 (a diaphragm that also serves as a common electrode) which forms the ceiling of each pressure chamber 162. When a drive voltage is applied to the individual electrode 167, the piezoelectric element 168 is deformed and the ink is thereby ejected through the nozzle 161. When ink is ejected, new ink is supplied to the pressure chamber 162 from the common flow channel 165 through the supply port 164.

In the present example, a piezoelectric element 168 is used as an ink ejection force generating device which causes ink to be ejected from a nozzle 161 provided in an ink head 160, but it is also possible to employ a thermal method in which a heater is provided inside each pressure chamber 162 and ink is ejected by using the pressure of the film boiling action caused by the heating action of this heater.

Figure 5:
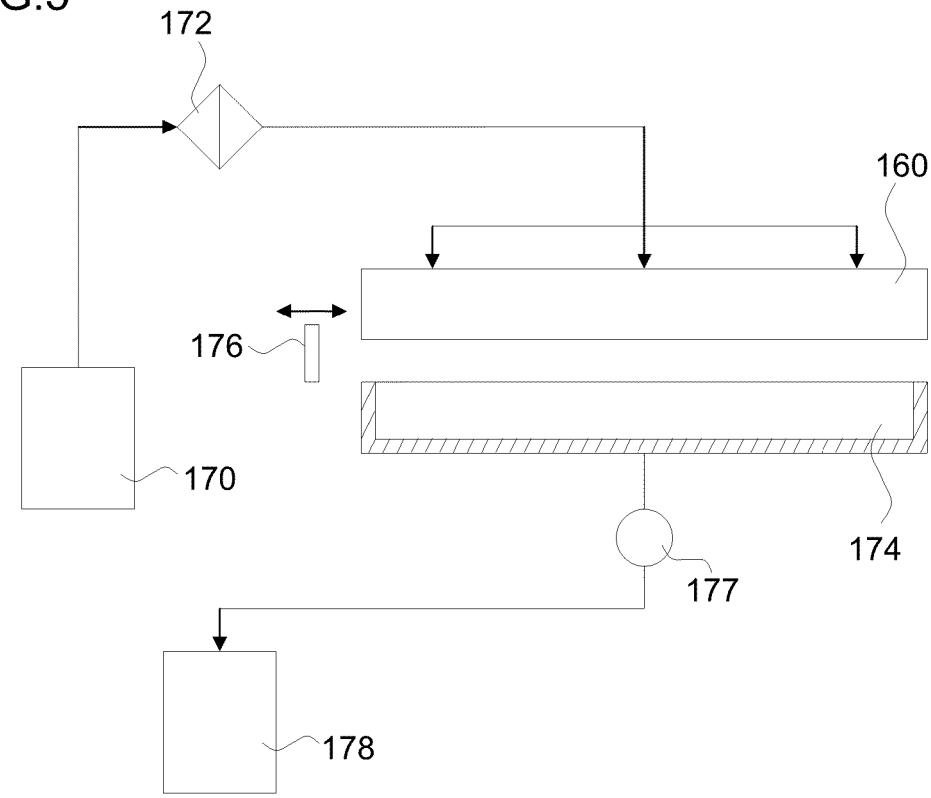
FIG. 5 is a schematic drawing showing the composition of an ink supply system in an inkjet recording apparatus.

FIG. 5 is a schematic drawing illustrating the configuration of the ink supply system in the inkjet recording apparatus 100. The ink supply tank 170 is a base tank to supply ink to the ink head 160. The aspects of the ink supply tank 170 include a refillable type and a cartridge type: when the remaining amount of ink is low, the ink tank of the refillable type is filled with ink through a filling port (not illustrated) and the ink tank of the cartridge type is replaced with a new one. In order to change the ink type in accordance with the intended application, the cartridge type is suitable, and it is desirable to represent the ink type information with a bar code or the like, and to perform ejection control in accordance with the ink type.

A filter 172 for removing foreign matters and bubbles is disposed in the middle of the channel connecting the ink supply tank 170 and the ink head 160 as illustrated in FIG. 5. The filter mesh size in the filter 62 is desirably equivalent to or not more than the diameter of the nozzle of print head and commonly about 20 μm.

Although not illustrated in FIG. 5, it is desirable to provide a sub-tank integrally to the ink head 160 or nearby the ink head 160. The sub-tank has a damper function for preventing variation in the internal pressure of the ink head 160 and a function for improving refilling of the print head.

The inkjet recording apparatus 100 is also provided with a cap 174 as a device to prevent the nozzles from drying out or to prevent an increase in the ink viscosity in the vicinity of the nozzles, and a cleaning blade 176 as a device to clean the ink ejection surface of the head 160.

A maintenance unit including the cap 174 and the cleaning blade 176 can be relatively moved with respect to the ink head 160 by a movement mechanism (not illustrated), and is moved from a place for recording to a place for maintenance above the maintenance unit as required.

The cap 174 is displaced up and down relatively with respect to the ink head 160 by an elevator mechanism (not illustrated). When the power of the inkjet recording apparatus 100 is turned OFF or when the apparatus 100 is in a standby state for printing, the elevator mechanism raises the cap 174 to a predetermined elevated position so as to come into close contact with the ink head 160, and the nozzle region of the nozzle surface 50A is thereby covered by the cap 174.

During printing or during standby, if the use frequency of a particular nozzle 161 has declined and the non-ejection of the ink continues for over a certain time, then the ink solvent in the vicinity of nozzles evaporates off and thereby the ink viscosity in the vicinity of the nozzle has increased. Once the ink reaches the state of this kind, it is difficult to eject the ink from the nozzles 161 even if the piezoelectric elements 168 (see FIG. 4) operate.

Therefore, before a situation of this kind develops (namely, while the ink is within a range of viscosity which allows it to be ejected by operation of a piezoelectric element 168), the piezoelectric element 168 is operated, and a preliminary ejection ("purge", "blank ejection", "liquid ejection" or "dummy ejection") is carried out toward the cap 174 (ink receptacle), in order to expel the degraded ink (namely, the ink in the vicinity of the nozzle which has increased viscosity).

Furthermore, if air bubbles enter into the ink inside the head 160 (inside the pressure chamber 162), then even if the piezoelectric element 168 is operated, it may not be possible to eject ink from the nozzle. In a case of this kind, the cap 174 is placed on the head 160, the ink (ink containing air bubbles) inside the pressure chamber 162 is removed by suction, by means of a suction pump 177, and the ink removed by suction is then supplied to a recovery tank 178.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 162, the ink consumption is considerably large. Therefore, a mode in which preliminary ejection is carried out when the increase in the viscosity of the ink is still minor, is desirable.

The cleaning blade 176 is composed of rubber or another elastic member, and can slide on the ink ejection surface of the ink head 160 by means of a blade movement mechanism (not illustrated). When ink droplets or foreign matter has adhered to the ink ejection surface, the ink ejection surface is wiped and cleaned by sliding the cleaning blade 176 on the ink ejection surface.

The inkjet recording apparatus 100 according to the present embodiment is provided in such a manner a nozzle having an ejection abnormality is judged from the read results of the in-line sensor 144 (see FIG. 1) and this judged ejection abnormality nozzle is subject to the recovery treatment. The recovery treatment according to the present embodiment includes the preliminary ejection and suction described above.

Figure 6:
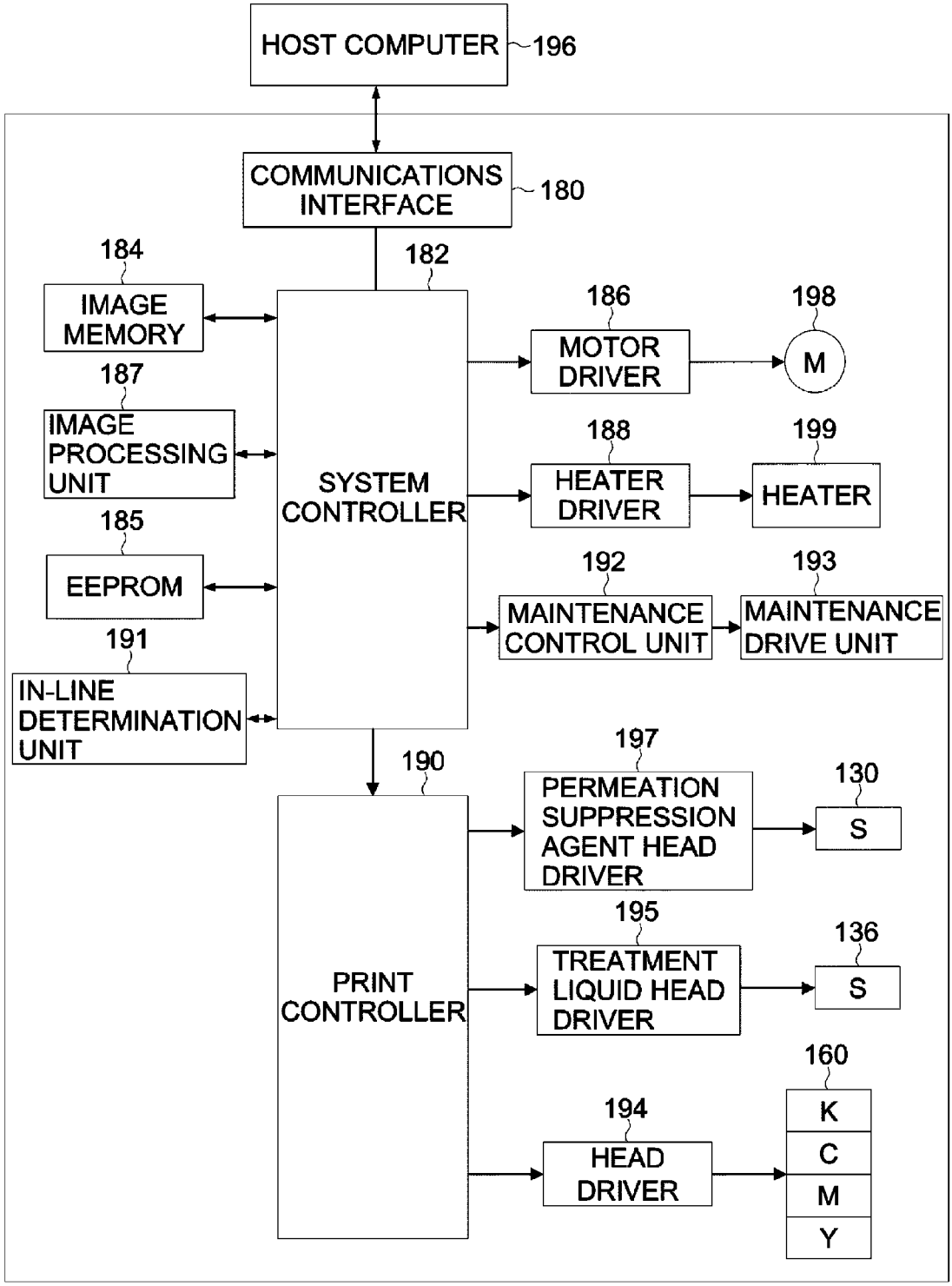
FIG. 6 is a principal block diagram showing the system composition of an inkjet recording apparatus.

FIG. 6 is a principal block diagram illustrating the system configuration of the inkjet recording apparatus 100.

The inkjet recording apparatus 100 comprises a communications interface 180, a system controller 182, an image memory 184, a motor driver 186, a heater driver 188, a print controller 190, a maintenance controller 192, a head driver 194, and the like.

The communications interface 180 is an interface unit for receiving image data sent from a host computer 196. A serial interface such as USB (Universal Serial Bus), IEEE1394, Ethernet (registered trademark), wireless network, or a parallel interface such as a Centronics interface may be used as the communications interface 180. A buffer memory (not illustrated) may be mounted in this portion in order to increase the communication speed. The image data sent from the host computer 196 is received by the inkjet recording apparatus 100 through the communications interface 180, and is temporarily stored in the image memory 184.

The image memory 184 is a storage device for temporarily storing images inputted through the communications interface 180, and data is written and read to and from the image memory 184 through the system controller 182. The image memory 184 is not limited to a memory composed of semiconductor elements, and a hard disk drive or another magnetic medium may be used.

The system controller 182 is constituted by a central processing unit (CPU) and peripheral circuits thereof, and the like, and it functions as a control device for controlling the whole of the inkjet recording apparatus 100 in accordance with prescribed programs, as well as a calculation device for performing various calculations. More specifically, the system controller 182 controls the various sections, such as the communications interface 180, image memory 184, motor driver 186, heater driver 188, and the like, as well as controlling communications with the host computer 196, and it also generates control signals for controlling the heater 199.

Programs executed by the CPU of the system controller 182 and the various types of data which are required for control procedures are stored in the image memory 184. The image memory 184 may be a non-writeable storage device, or it may be a rewriteable storage device, such as an EEPROM. The image memory 184 is used as a temporary storage region for the image data, and it is also used as a program development region and a calculation work region for the CPU.

Furthermore, an EEPROM 185 storing various control programs and an image processing unit 187 which performs various image processes in respect of the image data are connected to the system controller 182. A control program is read in from the EEPROM 185 and executed in accordance with an instruction from the system controller 182. The EEPROM 185 may also serve as a storage device for operating parameters, and the like.

The motor driver 186 is a driver which drives the motor 198 in accordance with instructions from the system controller 182. In FIG. 6, the motors (actuators) disposed in the respective sections of the inkjet recording apparatus 100 are represented by the reference numeral 198. For example, the motor 198 illustrated in FIG. 6 includes motors which drive the pressure drums 126*a* to 126*d* in FIG. 1, the transfer drums 124*a* to 124*d* and the paper output drum 150.

The heater driver 188 is a driver which drives the heater 199 in accordance with instructions from the system controller 182. In FIG. 6, the plurality of heaters which are provided in the inkjet recording apparatus 100 are represented by the reference numeral 199. For example, the heater 199 illustrated in FIG. 6 includes the heaters of the paper preheating units 128 and 134 illustrated in FIG. 1, the permeation suppression agent drying unit 132, the treatment liquid drying unit 138, the solvent drying unit 142*a* and 142*b*, the heating rollers 148*a* and 148*b*, and the like.

Apart from this, a maintenance controller 192 is connected to the system controller 182. The maintenance controller 192 controls a maintenance drive unit 193 which drives a maintenance unit including the cap 174 and the cleaning blade 176 in accordance with instructions from the system controller 182.

The print controller 190 is a controller which has a signal processing function for carrying out various treatments, corrections, and the like, in order to generate a signal for controlling printing from the image data in the image memory 184, under the control of the system controller 182, and before printing, the print controller 190 controls the permeation suppression agent head driver 197 and the treatment liquid head driver 195 so as to deposit the permeation suppression agent and treatment liquid onto the recording medium 114 respectively from the permeation suppression agent head 130 and the treatment liquid head 136, as well as supplying the generated print data (dot data) to the head driver 194. Prescribed signal processing is carried out in the print controller 190, and the ejection volume and the ejection timing of the ink droplets in the ink head 160 are controlled via the head driver 194 on the basis of the image data. By this means, desired dot size and dot positions can be achieved.

The in-line determination unit 191 carries out normal ejection failure determination which judges ejection abnormality nozzles, on the basis of information obtained from the in-line sensor 144, as well as carrying out investigation of the performance of this ejection failure determination, which is described in detail later on.

When the in-line determination unit 191 performs the normal ejection failure determination, judging ejection abnormality nozzles is carried out, and if it is possible to compensate the ejection abnormality nozzles by means of image correction, then it sends control signals to corresponding parts via the system controller 182 so as to perform the recovery action with respect to the ejection abnormality nozzles, such as preliminary ejection or suctioning.

Next, actions of the inkjet recording apparatus having the above-described structure are described.

The recording medium 114 is conveyed to the supply paper tray 122 from the magazine 120 of the paper supply unit 102. The recording medium 114 is held on the pressure drum 126*a* of the permeation suppression processing unit 104, via the transfer drum 124*a*, and is preheated by the paper preheating unit 128, and droplets of permeation suppression agent are ejected by the permeation suppression agent head 130. Thereupon, the recording medium 114 which is held on the pressure drum 126*a* is heated by the permeation suppression agent drying unit 132, and the solvent component (liquid component) of the permeation suppression agent is evaporated and dried.

The recording medium 114 which has been subjected to permeation suppression processing in this way is transferred from the pressure drum 126*a* of the permeation suppression processing unit 104 via the transfer drum 124*b* to the pressure drum 126*b* of the treatment liquid deposition unit 106.

The recording medium 114 which is held on the pressure drum 126*b* is preheated by the paper preheating unit 134 and droplets of treatment liquid are ejected by the treatment liquid head 136. Thereupon, the recording medium 114 which is held on the pressure drum 126*b* is heated by the treatment liquid drying unit 138, and the solvent component (liquid component) of the treatment liquid is evaporated and dried. By this means, a layer of aggregating treatment agent in a solid state or semi-solid state is formed on the recording medium 114.

The recording medium 114 on which a solid or semi-solid layer of aggregating treatment agent has been formed is transferred from the pressure drum 126*b* of the treatment liquid deposition unit 106 via the transfer drum 124*c* to the pressure drum 126*c* of the print unit 108. Droplets of corresponding colored inks are ejected respectively from the ink heads 140C, 140M, 140Y, 140K, 140R, 140G and 140B, onto the recording medium 114 held on the pressure drum 126*c*, in accordance with the input image data.

When ink droplets are deposited onto the aggregating treatment agent layer, then the contact surface between the ink droplets and the aggregating treatment agent layer is a prescribed surface area when the ink lands, due to a balance between the propulsion energy and the surface energy. An aggregating reaction starts immediately after the ink droplets land on the aggregating treatment agent, but the aggregating reaction starts from the contact surface between the ink droplets and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink have already aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the recording medium 114.

Thereupon, the recording medium 114 held on the pressure drum 126*c* is heated by the solvent drying units 142*a* and 142*b*, and the solvent component (liquid component) which has been separated from the ink aggregate on the recording medium 114 is evaporated off and dried. As a result, curling of the recording medium 114 is prevented, and furthermore deterioration of the image quality as a result of the presence of the solvent component can be restricted.

The recording medium 114 onto which colored inks have been deposited by the print unit 108 is transferred from the pressure drum 126*c* of the print unit 108 via the transfer drum 124*d* to the pressure drum 126*d* of the fixing processing unit 110. After the printing results achieved by the print unit 108 are read out by the in-line sensor 144 from the recording medium 114 held on the pressure drum 126*d*, then heating and pressure processing are carried out by the heating rollers 148*a* and 148*b*.

When the recording medium 114 is further transferred from the pressure drum 126*d* to the paper output drum 150, it is conveyed to the paper output platform 152 by the paper output chain 154. The recording medium 114 on which an image has been formed in this way is then conveyed onto the paper output platform 152 by the paper output chain 154 and is stacked on the paper output platform 152.

Next, the method of investigating ejection failure determination performance, which is one of the key points of the present embodiment, will be described.

The present embodiment relates to an inkjet recording apparatus which investigates whether or not ejection failure nozzles are determined in a correct fashion in an inkjet recording apparatus, in other words, whether or not the ejection failure determination performance is correct. For this purpose, the inkjet recording apparatus has a composition for confirming the determinability of an ejection failure determination pattern in such a manner ejection failure nozzle can be determined correctly at all times.

To give a more detailed description, an investigation pattern in which a particular nozzle is taken to be suffering an ejection failure is generated, this investigation pattern is ejected onto a recording medium from an ink head and read in by an in-line sensor, and the read result is compared with the generated investigation pattern to judge whether or not the particular nozzle has been recognized reliably as an ejection failure nozzle. It is confirmed whether or not the performance in determining ejection failure nozzles has been set correctly by judging whether or not the number of mistakenly recognized nozzles is equal to or lower than a reference value. If it is judged that the ejection failure nozzle determination performance has not been set correctly, then the determination conditions are changed automatically so as to improve the determination performance.

The investigation of ejection failure determination performance is described below.

Firstly, an ejection failure determination pattern is generated. The ejection failure determination pattern is generated by taking a pattern of a particular range as a basis of the repetition cycle and repeating this pattern to form an image of one page of the recording medium.

The pattern forming this repetition basis (a particular range of the ejection failure determination pattern) is generated in advance by the system control unit 182 and is stored in the image memory 184. A portion where ink is not output, thus forming an ejection failure (non-ejection part), is set within the pattern of the particular range. This pattern is rewritten periodically by the host computer 196.

The ejection failure determination pattern has a pitch in the breadthways direction of the recording medium 114 which is equal to or greater than the pixel pitch of the in-line sensor 144 which captures an image of the pattern, in such a manner that only the output of at most one nozzle is included in one pixel. Furthermore, the pitch of the pattern in the conveyance direction is a length equal to or greater than the pixel pitch of the in-line sensor 144 which captures an image of the output from one nozzle. In this case, desirably, the pattern of a following stage is moved in the breadthways direction of the recording medium 114 by at least the pixel pitch of the in-line sensor 144, so as not to be continuous with the pattern of the preceding stage.

Figure 7:
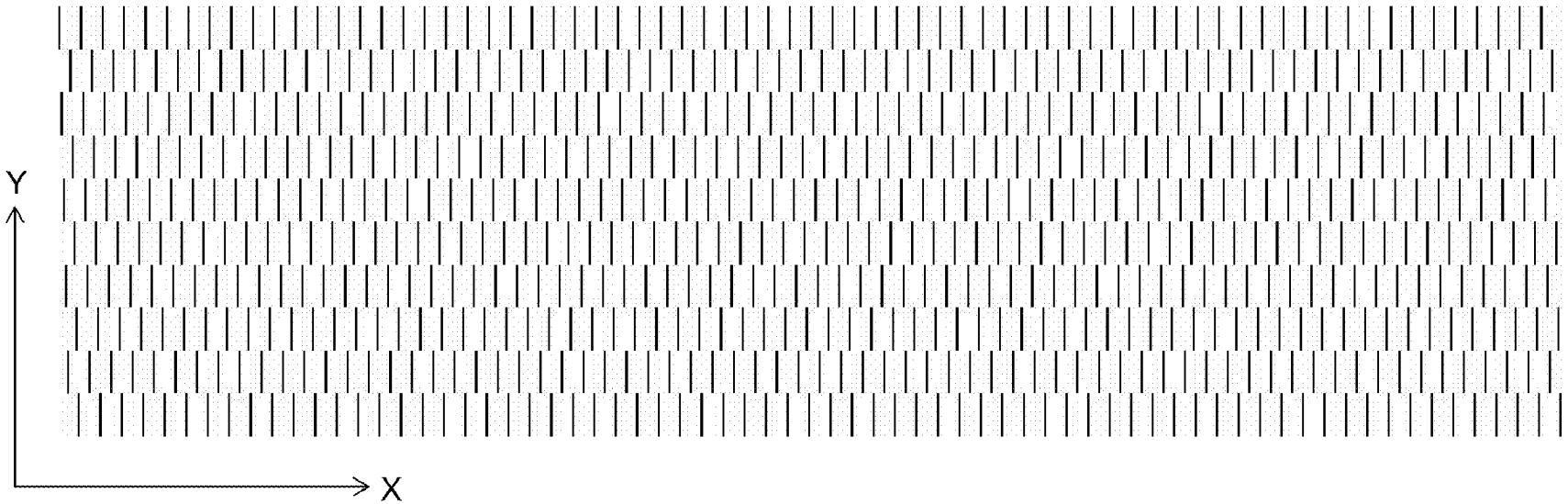
FIG. 7 is an illustrative diagram showing an example of an ejection failure determination pattern.
Figure 8:
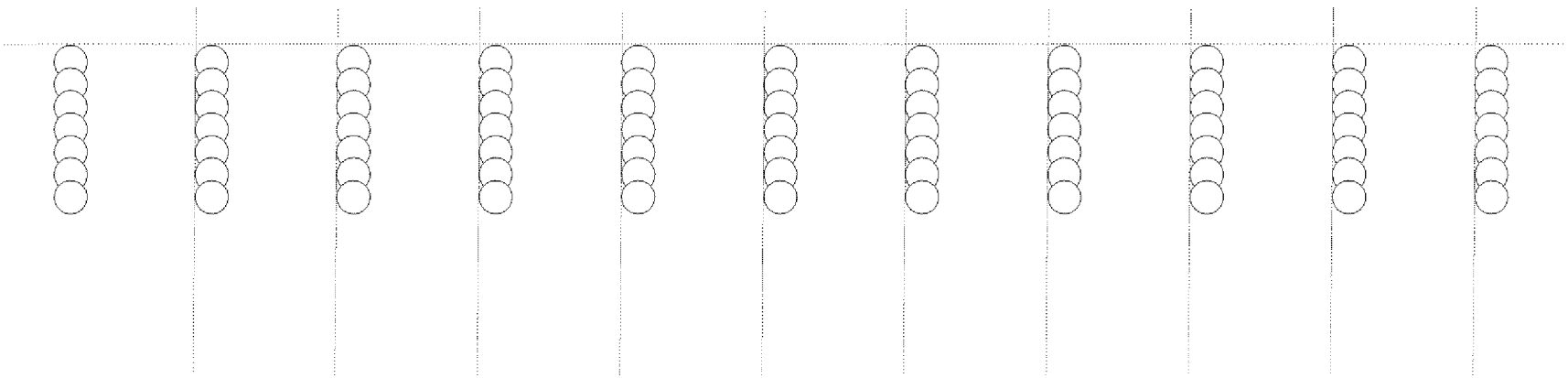
FIG. 8 is an illustrative diagram showing the example of the ejection failure determination pattern.
Figure 9:
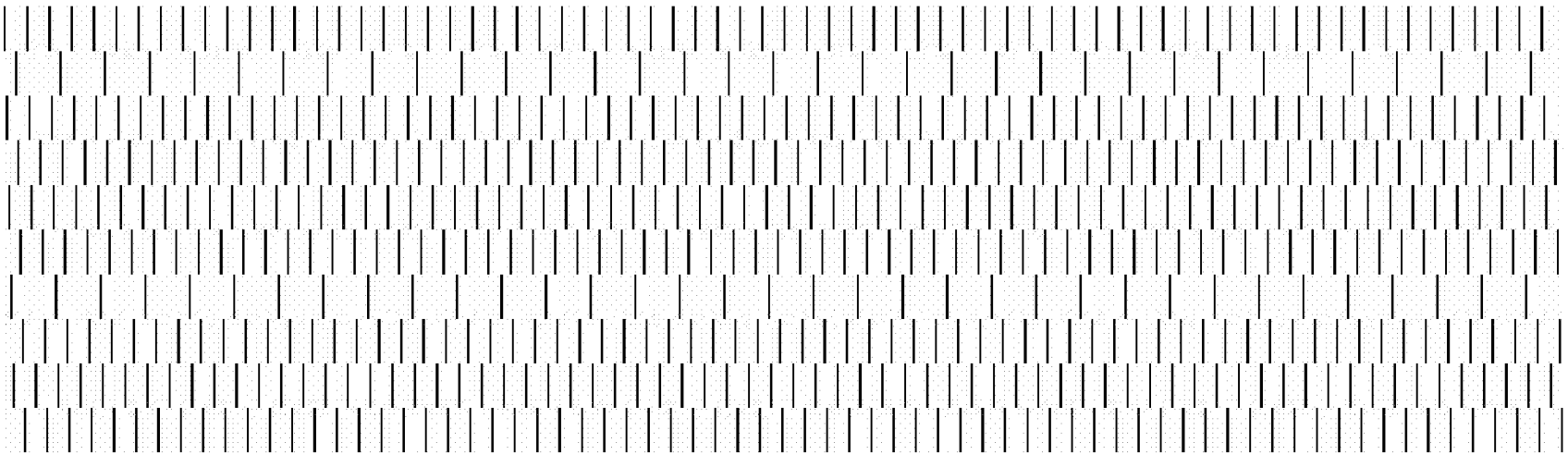
FIG. 9 is an illustrative diagram showing an example of a determination pattern for investigating ejection failure determinability.

FIGS. 7 to 9 show examples of an ejection failure determination pattern.

In FIG. 7, the Y direction is the conveyance direction of the recording medium 114 (the sub-scanning direction) and the X direction in the lengthwise direction of the ink head 160 (main scanning direction). The ejection failure determination pattern shown in FIG. 7 is formed by ejecting droplets in line segments of a prescribed length by means of a plurality of dots in the Y direction, at intervals of a prescribed number of nozzles in the X direction, in each stage of the pattern.

FIG. 8 is a schematic drawing showing an enlarged view of respective line segments. As shown in FIG. 8, the line segments are each formed by aligning a plurality of dots in the vertical direction (Y direction) to form a line segment having a width corresponding to one dot.

In the example of the ejection failure determination pattern shown in FIG. 7, the left-hand-most line segments, for example, in the respective stages are mutually adjacent in the X direction when projected to the X axis (Y=0), in every other stage of the pattern, for example, the first, third, fifth, seventh and ninth stages, and all of the line segments in each stage are composed in such a manner that there is an interval of ten lines between adjacent line segments.

Ejection failure determination patterns such as that shown in FIG. 7 are arranged respectively for the colors of M, K, C and Y, on one sheet of recording medium 114.

An investigation pattern is shown in FIG. 9. This pattern is formed by in practice artificially setting up an ejection failure, with respect to the ejection failure pattern shown in FIG. 7 and described above. In the investigation pattern shown in FIG. 9, the outputs from the second and seventh nozzles are set to ejection failure (off), in every other nozzle, in the ejection failure determination pattern shown in FIG. 7.

Thereupon, this kind of investigation pattern of the ejection failure determination pattern is output from the print controller 190 via a head driver 194 and onto a recording medium 114 by the ink head 160. The ejection failure determination pattern output onto the recording medium 114 is read in by the in-line sensor 144. The data read in is sent to the in-line determination unit 191, binarized using a certain value as a threshold value, and then compared with the output data of the ejection failure determination pattern.

Figure 10:
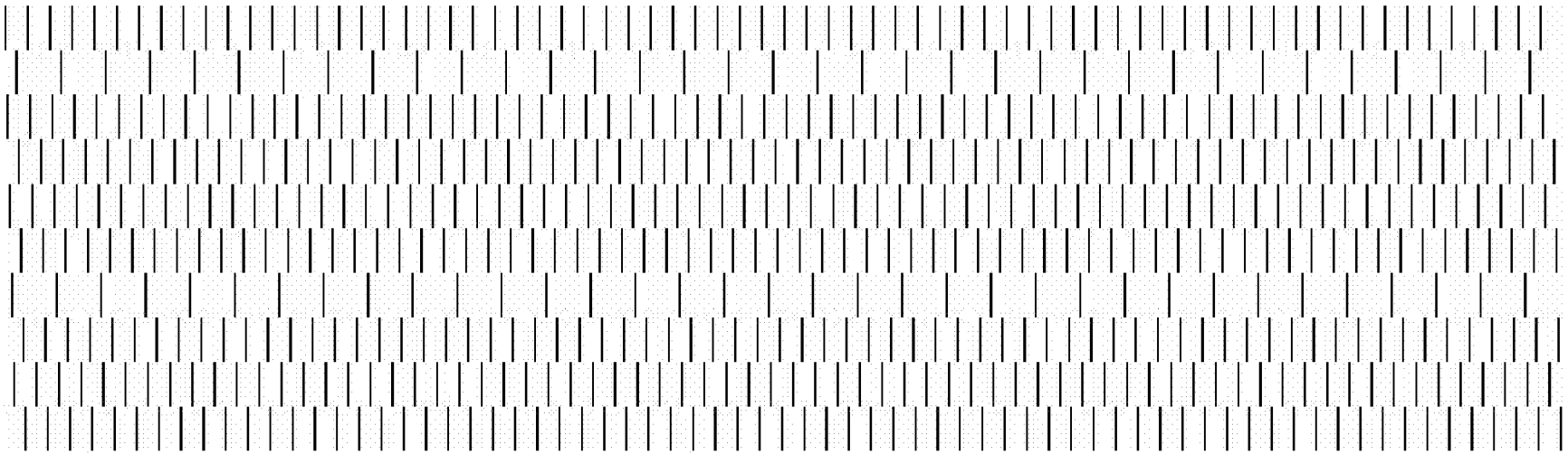
FIG. 10 is an illustrative diagram showing an example of results data obtained by reading out an investigation pattern.

If the binarization level is correct in this case, then as shown in FIG. 10, in the determination results data obtained by binarizing the read data, the same nozzles as the ejection failure nozzles in accordance with the generated investigation pattern shown in FIG. 9 are recognized as failure nozzles.

Figure 11:
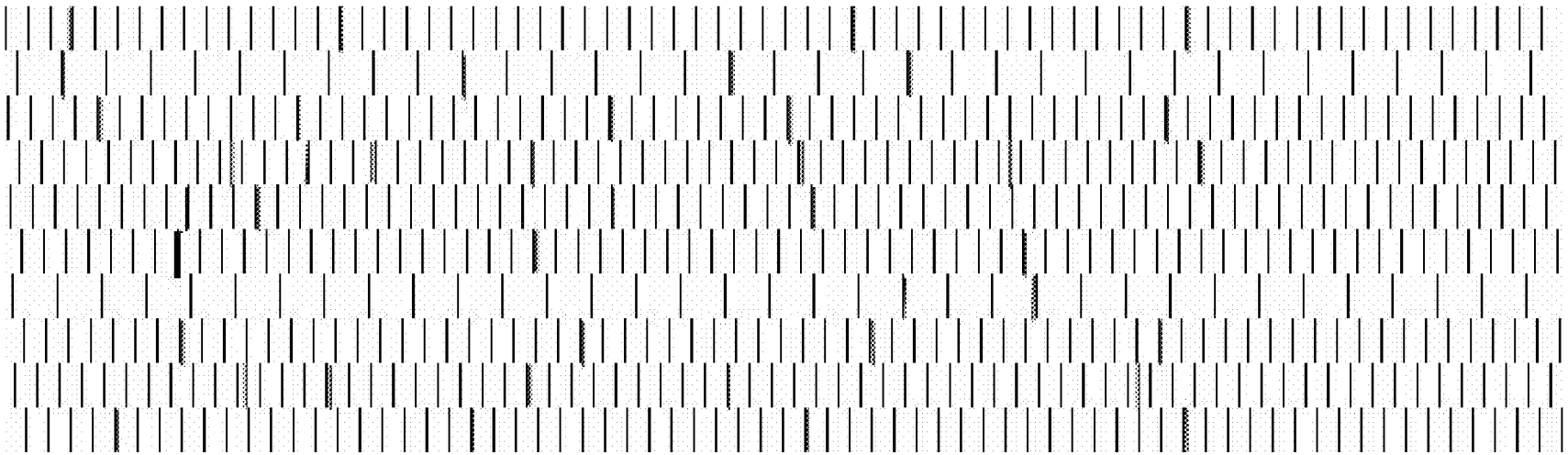
FIG. 11 is an illustrative diagram showing a further example of results data obtained by reading out an investigation pattern.

However, if the binarization level is lower than a suitable value, for example, then there is a possibility that even nozzles which should be judged to be suffering ejection failure are recognized as having performed ejection. Therefore, as shown in FIG. 11, for example, results which indicate ejection being performed from a larger number of nozzles than the investigation pattern shown in FIG. 9 are obtained.

Figure 12:
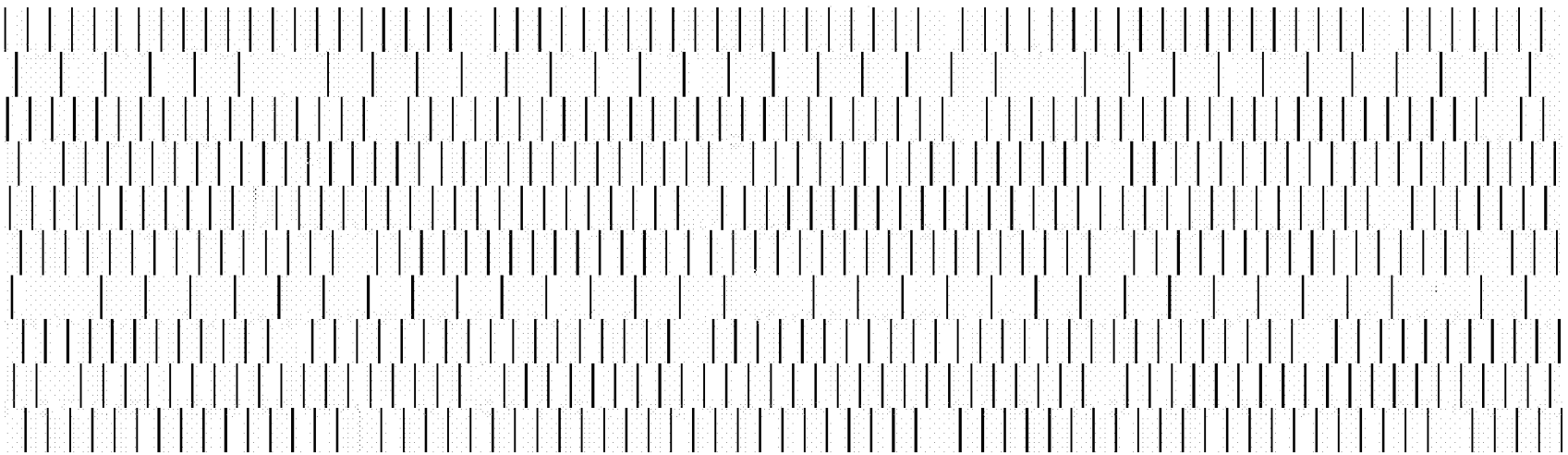
FIG. 12 is an illustrative diagram showing a further example of results data obtained by reading out an investigation pattern.

Furthermore, if, on the other hand, the binarization level is higher than a suitable value, then there is a possibility that nozzles which have actually performed ejection can be recognized as ejection failure nozzles, and consequently, as shown in FIG. 12, a larger number of nozzles are recognized as ejection failure nozzles than in the investigation pattern in FIG. 9.

More specifically, when the results data obtained by binarizing the read data using a threshold value of 112/255, for instance, was compared with the data of the ejection failure determination pattern generated previously, the number of nozzles recognized as ejection failure nozzles was 50% higher than the number of nozzles which were set previously as ejection failures. Here, 255/255 represents white and 0/255 represents black.

The reason why the number of nozzles recognized as ejection failures was greater than the number of ejection failure nozzles which were set in the investigation pattern in this way, was because the binarization threshold value was higher than a suitable value, as described previously. Therefore, the investigation pattern was output again to the recording medium 114 and the results read in by the in-line sensor 144 were binarized using a threshold value of 89/255. When this results data was compared with the data of the investigation pattern, it was clear that the results coincided with the investigation pattern by 90% or more.

Accordingly, the binarization processing thereafter was carried out using a threshold value of 89/255. In this way, if the threshold value for the binarization process is not a suitable value, then the determination conditions for investigating the ejection failure determination performance are altered by automatically changing the binarization threshold value by means of the system controller 182, in accordance with the respective number of ejection failure nozzles obtained from the determination data and the number of ejection failure nozzles set in the investigation pattern, and therefore ejection failure determination can be carried out accurately at all times.

Since the binarization threshold value is affected by the investigation pattern, then it is desirable that each time the investigation pattern should be updated periodically by the host computer 196, the investigation of the ejection failure determination performance should be carried out and the binarization threshold value should be reset to a suitable value.

Furthermore, the binarization threshold value is also affected by the reflectivity of the recording medium 114, for instance, as well as the investigation pattern. For example, when the paper being used was changed from a matt art paper to a gloss art paper having high glossiness, then with an unchanged binarization threshold value of 89/255, the match rate with the investigation pattern fell to 85%.

The paper is not completely smooth and has fine indentations in the surface thereof. Therefore, in paper which does not have a smooth surface, the direction in which light is reflected is dispersed and there is a strong tendency towards diffuse reflection. The smoother the surface, the greater the specular reflection component, and the higher the glossiness of the paper. Papers which are formed with a surface coating in order to raise the glossiness are known as gloss art papers (coated papers). On the other hand, papers which are processed so as to increase the diffuse reflection component and thereby reduce the glossiness in both the white surface and the color portions, are known as matt art papers.

Since the match rate with the investigation pattern was reduced to 85% when using a binarization threshold value of 89/255, the match rate with the investigation pattern was returned to 91% when the binarization threshold value was raised to 122/255. Therefore, the binarization threshold value thereafter was taken to be 122/255.

Desirably, this investigation of the ejection failure determination performance should be carried out by outputting an investigation pattern before carrying out a normal image recording operation by the inkjet recording apparatus 100 and confirming the match rate of the investigation pattern as described above.

Furthermore, rather than simply looking at the match rate by binarization using a single threshold value in this way, it is also possible to carry out binarization in three levels, for example, and to compare the respective match rates. If the same trend of change in the match rate is seen in the three levels, then it is possible to employ an algorithm to select a fourth binarization level following this trend and determine a level where the trend becomes saturated or select the peak match rate. By this means, it is possible to compose an image recording apparatus capable of autonomously selecting a binarization level having the highest match rate.

In the example described above, a full line type of inkjet head is used, but the present invention can also be applied to inkjet heads other than a full line type.

For example, the present invention can also be applied to an inkjet head of a shuttle (serial) type which uses a single writing action. This is described briefly below.

Here, a single writing action means being able to form an image on a recording medium (on the range thereof which passes the inkjet head) by passing an inkjet head just once over the recording medium (or a particular range thereof).

Figure 13A:
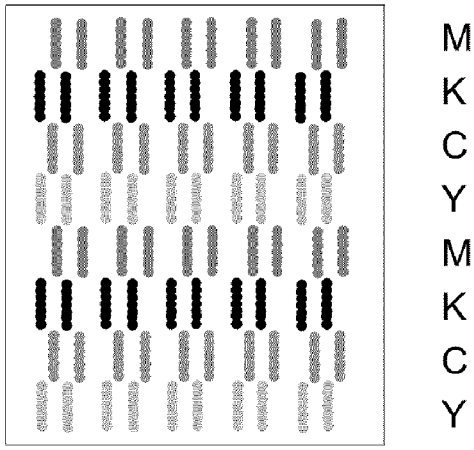
FIGS. 13A to 13C are illustrative diagrams each showing an investigation pattern in the case of a shuttle type head.
Figure 13B:
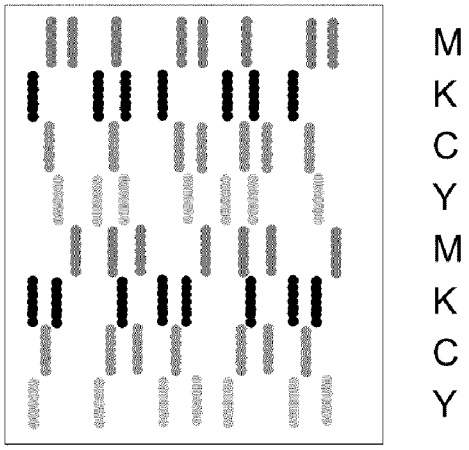
Figure 13C:
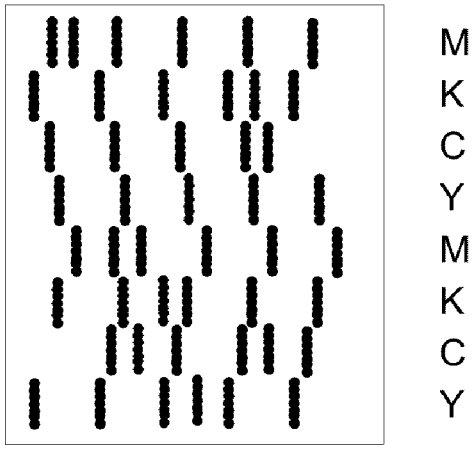

FIGS. 13A to 13C show examples of an investigation pattern in the case of a shuttle type head.

The pattern shown in FIG. 13A is a normal ejection failure determination pattern, and depicts a case where the four colors of M, K, C and Y are output twice onto one sheet of recording medium 114. Similarly to the pattern shown in FIG. 9 and the like, line segments of a length corresponding to a plurality of dots are recorded for each respective color. The scanning (movement) direction of the shuttle head is the lateral direction in FIGS. 13A to 13C.

The pattern shown in FIG. 13B is an investigation pattern in which a portion is deliberately set as an ejection failure by thinning out several line segments from the ejection failure determination pattern in FIG. 13A.

The method of investigating the ejection failure determination performance by comparing the data of the investigation pattern with data obtained by reading in the investigation pattern output in this way, by means of an in-line sensor 144, and binarizing this data using a prescribed threshold value, is similar to the example described above.

Furthermore, FIG. 13C is an example of determination data showing a case where the ratio of determination of ejection failures is high because the determination processing conditions and the binarization threshold value are not suitable.

Next, the investigation procedure of the ejection failure determination performance in the present embodiment will be summarized with reference to a flowchart.

Figure 14:
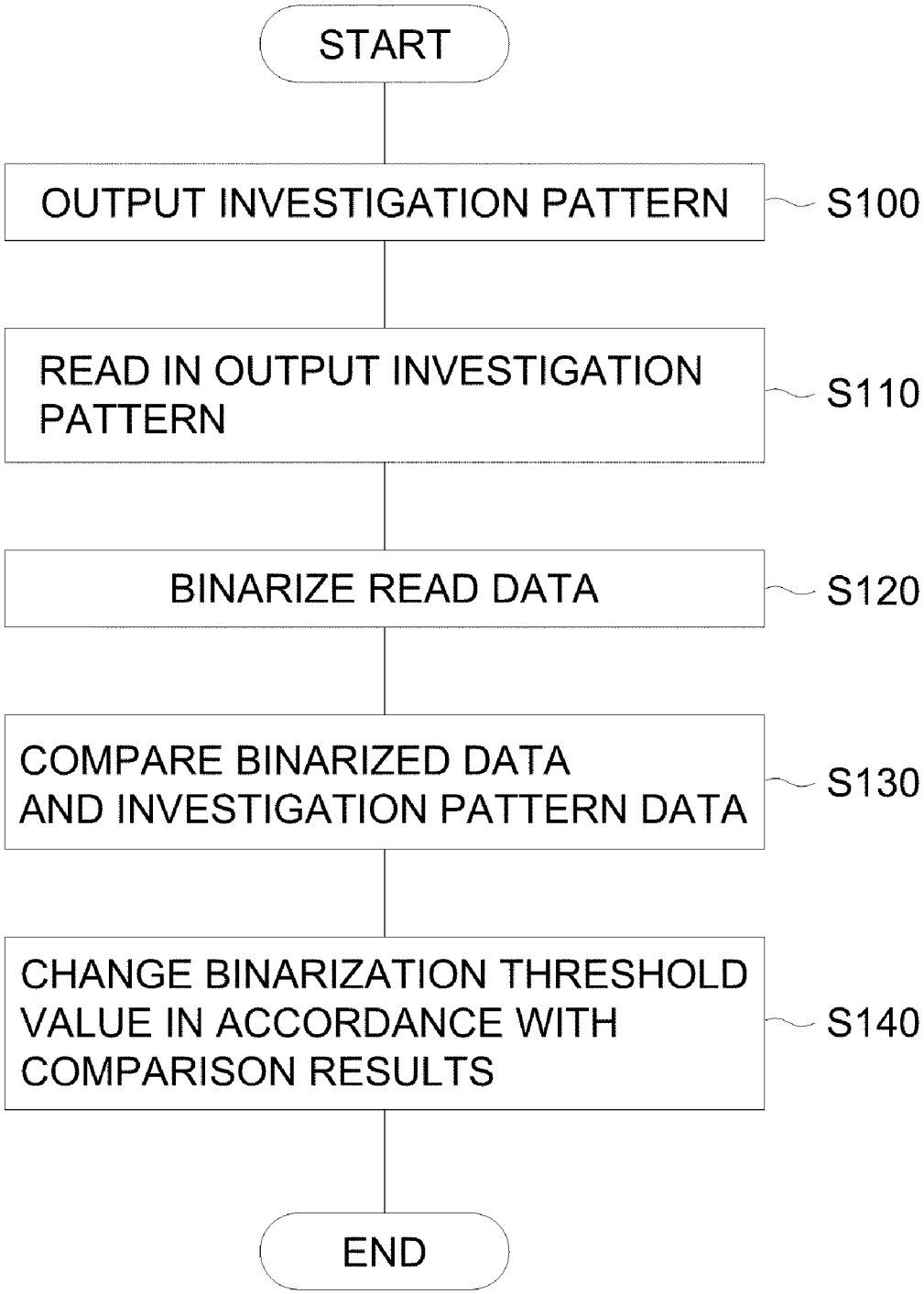
FIG. 14 is a flowchart showing a sequence of a process of investigating the ejection failure determination performance.

FIG. 14 shows a flowchart of the sequence of a process of investigating the ejection failure determination performance.

Firstly, in the step S100 in FIG. 14, the determination pattern shown in FIG. 9, for example, is output from the ink head 160 onto the recording medium 114.

Thereupon, at step S110, the investigation pattern output onto the recording medium 114 is read in by the in-line sensor 144. The data thus read in is sent via the system controller 182 to the in-line determination unit 191.

Thereupon, at step S120, the in-line determination unit 191 binarizes the data thus sent, by using a prescribed threshold value.

Next, at step S130, the data of the result obtained by this binarization process is compared with the investigation pattern data.

Finally, at step S140, the binarization threshold value is changed, if necessary, in accordance with the comparison results. For instance, if the threshold value is low and the number of nozzles recognized as ejection failure nozzles is greater than the number set in the investigation pattern, then the threshold value is raised, whereas if the threshold value is high and the number of nozzles recognized as ejection failure nozzles is lower than the number set in the investigation pattern, then the threshold value is lowered.

Furthermore, in the example described above, the threshold value of the binarization process is changed so as to become a suitable value, as an ejection failure determination condition, but it is also possible to use a sharpening process, or the like, other than a binarization process.

For example, if a binarization process is carried out by converting an image which has smooth density change in the outlines of the read image, to a sharp image, then it is possible to improve the ejection failure nozzle determination rate by altering the conditions of the sharpness processing.

In general, the sharpness processing is able to emphasize the density change in the edge portions by subtracting from the read image a secondary differentiation image (Laplacian image) of the image.

Figure 15A:
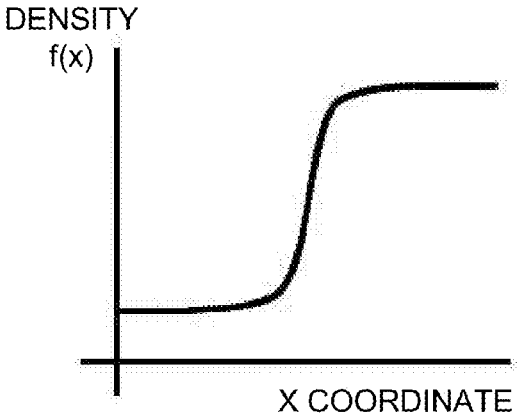
FIGS. 15A to 15D are illustrative diagrams showing an example of processing in a sharpening process.
Figure 15B:
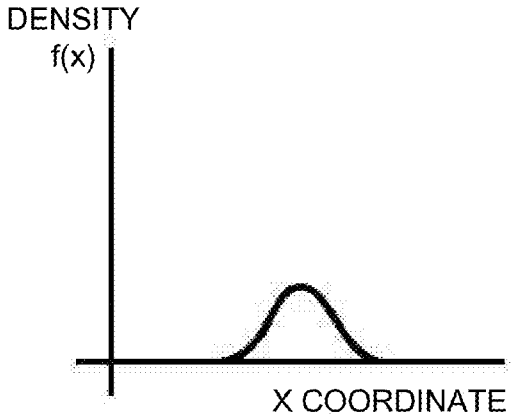
Figure 15C:
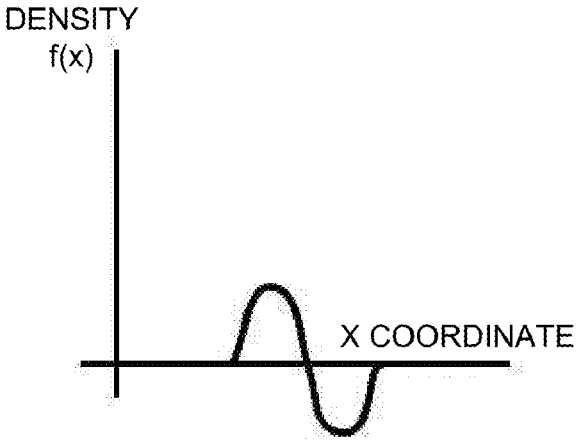

FIGS. 15A to 15D show an example of this method. Firstly, it is supposed that there is an original image having a density change such as that shown in FIG. 15A. FIG. 15B shows the results of primary differentiation of this original image data. Furthermore, FIG. 15C shows the results of the secondary differentiation of the original image data.

Figure 15D:
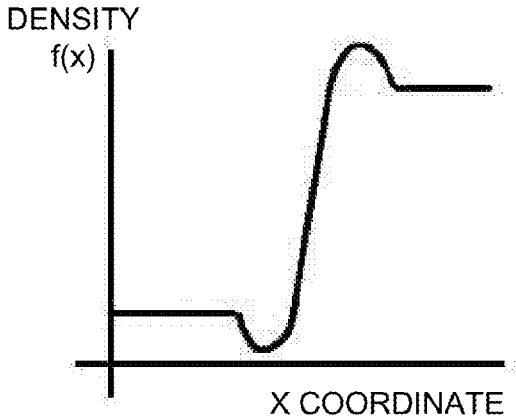

On the other hand, FIG. 15D shows the results of subtracting the secondary differential results in FIG. 15C from the original image data shown in FIG. 15A. In this way, in FIG. 15D, the density change is made sharper than in FIG. 15A.

Therefore, in the case of a sharpening process, it is possible to adjust the sharpness results by changing the differential coefficient of the primary differentiation and the secondary differentiation, or by changing the coefficient used when subtracting the secondary differentiation image from the original image. By this means, it is possible to improve the ejection failure determination performance.

As described above, according to the present embodiment, an investigation pattern for investigating the ejection failure determination conditions is output, in which output is not performed from particular nozzles, this pattern is read in by an in-line sensor and subjected to prescribed processing and then compared with the investigation pattern to investigate the determinability, and furthermore, the ejection failure determination conditions are amended (changed) autonomously, whereby it becomes possible to maintain high determinability in respect of ejection failure nozzles, even if there is change in the determination pattern, the paper or the ink. Moreover, since the ejection failure determinability is raised, then it is possible to eliminate situations where ejection failure states are overlooked or where, conversely, the apparatus is transferred excessively to the maintenance mode when there is no need to do so, and therefore the productivity can be improved.

Inkjet recording apparatuses and methods of investigating ejection failure determination performance according to the present invention are described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a head having a plurality of nozzles for ejecting ink onto a recording medium;

a conveyance device which conveys the recording medium in a prescribed direction along a conveyance path;

an investigation pattern generation device which generates a thinned-out investigation pattern that is to be output by causing the nozzles other than a portion of the plurality of nozzles of the head to eject the ink;

a reading device which is provided on the conveyance path and which reads in the investigation pattern output onto the recording medium; and a checking device which performs comparison between data of the investigation pattern read in by the reading device and data of the investigation pattern generated by the investigation pattern generation device, wherein a determination rate of ejection failure nozzles is found from result obtained by outputting the investigation pattern generated by the investigation pattern generation device onto the recording medium from the head, reading in the output investigation pattern by the reading device, and performing the comparison between the data of the investigation pattern thus read in and the data of the investigation pattern generated by the investigation pattern generation device.

2. The inkjet recording apparatus as defined in claim 1, wherein when the determination rate of ejection failure nozzles found is lower than a predetermined value, conditions for performing the comparison are changed to raise the determination rate of ejection failure nozzles.

3. The inkjet recording apparatus as defined in claim 2, wherein the conditions for performing the comparison are changed by changing a threshold value for binarizing the data of the investigation pattern read in by the reading device.

4. The inkjet recording apparatus as defined in claim 2, wherein the conditions for performing the comparison is changed by changing a prescribed coefficient for applying a sharpening process to the data of the investigation pattern read in by the reading device.

5. The inkjet recording apparatus as defined in claim 1, wherein:

the head is a full line type recording head; and the conveyance device causes relative conveyance between the recording medium and the head in a direction substantially perpendicular to a breadthways direction of the recording medium.

6. The inkjet recording apparatus as defined in claim 1, wherein the head is a shuttle type head which moves in a direction substantially perpendicular to the prescribed direction in which the conveyance device conveys the recording medium.

7. A method of investigating ejection failure determination performance, comprising the steps of:

generating a thinned-out investigation pattern that is to be output by causing nozzles other than a portion of a plurality of nozzles of a head to eject ink;

outputting the investigation pattern onto a recording medium;

reading the investigation pattern output onto the recording medium;

performing comparison between data of the read investigation pattern and data of the generated investigation pattern; and finding a determination rate of ejection failure nozzles according to result obtained by performing the comparison.

8. The method of investigating ejection failure determination performance as defined in claim 7, wherein when the determination rate of ejection failure nozzles found is lower than a predetermined value, conditions for performing the comparison are changed to raise the determination rate of ejection failure nozzles.

9. The method of investigating ejection failure determination performance as defined in claim 8, wherein the conditions for performing the comparison is changed by changing a threshold value for binarizing the data of the investigation pattern read in by the reading device.

10. The method of investigating ejection failure determination performance as defined in claim 8, wherein the conditions for performing the comparison are changed by changing a prescribed coefficient for applying a sharpening process to the data of the investigation pattern read in by the reading device.

11. The method of investigating ejection failure determination performance as defined in claim 7, wherein:

the head is a full line type recording head; and relative conveyance between the recording medium and the head is caused in a direction substantially perpendicular to a breadthways direction of the recording medium.

12. The method of investigating ejection failure determination performance as defined in claim 7, wherein the head is a shuttle type head which moves in a direction substantially perpendicular to a direction in which the recording medium is conveyed.

* * * * *